US005526716A

United States Patent [19]

Arai et al.

[11] Patent Number: 5,526,716

[45] Date of Patent: Jun. 18, 1996

[54] METHOD FOR MANUFACTURING A CUTTER

[75] Inventors: Tatsuo Arai; Takayoshi Saito, both of Ibaraki-ken, Japan

[73] Assignee: Mitsubishi Materials Corporation, Tokyo, Japan

[21] Appl. No.: 274,726

[22] Filed: Aug. 5, 1994

Related U.S. Application Data

[62] Division of Ser. No. 69,417, Jun. 1, 1993, Pat. No. 5,352, 067, which is a division of Ser. No. 857,989, Mar. 26, 1992, Pat. No. 5,240,356.

[30] Foreign Application Priority Data

| | | | |
|---|---|---|---|
| Mar. 28, 1991 | [JP] | Japan | 3-89720 |
| Aug. 6, 1991 | [JP] | Japan | 3-196882 |
| Aug. 8, 1991 | [JP] | Japan | 3-199640 |

[51] Int. Cl.[6] ..... B21K 5/04

[52] U.S. Cl. ..... 76/108.2; 76/108.1; 407/32

[58] Field of Search ..... 76/108.2, 108.1, 76/115, DIG. 11; 407/5, 6, 32, 119; 175/374

[56] References Cited

U.S. PATENT DOCUMENTS

| | | | |
|---|---|---|---|
| 2,788,302 | 4/1957 | Dew . | |
| 2,955,349 | 3/1958 | York . | |
| 3,273,221 | 1/1965 | Ewing . | |
| 3,513,728 | 5/1970 | Hudson et al. | 76/108.1 |
| 3,961,403 | 8/1976 | Hunkeler . | |
| 4,252,038 | 2/1982 | Subramanian et al. . | |
| 4,578,087 | 3/1986 | Tanaka et al. . | |
| 4,708,542 | 11/1987 | Emanuelli . | |
| 4,761,191 | 8/1988 | Keller et al. | 76/108.2 |
| 4,887,493 | 12/1989 | Drake . | |
| 4,909,677 | 3/1990 | Noguchi et al. . | |
| 4,966,501 | 10/1990 | Nomura et al. . | |
| 4,969,378 | 11/1990 | Lu et al. . | |
| 4,984,940 | 1/1991 | Bryant et al. . | |
| 5,075,181 | 12/1991 | Quinto et al. . | |
| 5,135,337 | 8/1992 | Adamson . | |
| 5,326,189 | 7/1994 | Beamer | 405/119 |
| 5,326,190 | 7/1994 | Beamer | 405/119 |

FOREIGN PATENT DOCUMENTS

| | | |
|---|---|---|
| 3906217 | 11/1989 | Germany . |
| 51-15871 | 2/1976 | Japan . |
| 54-134889 | 10/1979 | Japan . |
| 56-069370 | 6/1981 | Japan . |

*Primary Examiner*—Douglas D. Watts
*Attorney, Agent, or Firm*—Cushman, Darby & Cushman

[57] ABSTRACT

A cutting tool is disclosed which includes a tool body having a mounting portion to be secured to a machine tool and having a plurality of insert receiving recesses formed therein. A plurality of cutting inserts are releasably attached to the insert receiving recesses, respectively. The tool body has a nitrided hard layer formed on a surface thereof. Furthermore, a clamp member used in the tool preferably has an abutment surface to be held in abutting contact with the insert or other parts and a chip-contacting surface with which cutting chips produced during cutting operation are brought into contact. The chip-contacting surface is defined by a nitriding hard layer formed on a precision-cast unglazed surface, and has a surface which is left without finish-working. Furthermore, a method for producing a cutting tool which includes a tapped hole formed therein and having an inner surface defining an unnitrided portion is disclosed. In this method, a plug is first threaded into the tapped hole. Subsequently, the tool body is subjected to nitriding treatment to form a hard layer on the surface of the tool body, and the plug is subsequently removed from the tool body.

4 Claims, 15 Drawing Sheets

METHOD FOR MANUFACTURING A CUTTER

This is a division of application Ser. No. 08/069,417, filed Jun. 1, 1993, now U.S. Pat. No. 5,352,067 which was a divisional of application Ser. No. 07/857,989 filed Mar. 26, 1992 which is now U.S. Pat. No. 5,240,356 issued Aug. 31, 1993.

BACKGROUND OF THE INVENTION

1. Field of the Invention

The present invention relates to a cutter having a plurality of indexable cutter inserts attached to a tool body, and a method for manufacturing the same.

2. Prior Art

In the field of cutting tools, insert cutters, each of which comprises a plurality of indexable cutter inserts of a hard material such as cemented carbide releasably attached to a tool body of a steel such as tool steel, are extensively used.

In the cutters of this type, in order to prevent the outer peripheral surface of the tool body from being damaged due to the abrasion caused by cutting chips to thereby improve the durability of the tool body, the hardness of the tool body at its surface is enhanced to about $H_RC$ 45 by subjecting the tool body to quench hardening.

However, when the tool body is subjected to quench hardening, the tool body inevitably undergoes quenching distortion. For this reason, after the quench hardening, recesses for receiving inserts or those portions to be secured to a machine tool, such as the surface of a boss of a tool body in a face milling cutter or the outer surface of the shank in an end mill, which are all required to be formed with high precision, must be subjected to sanding or to cutting work using an end mill in order to remove the distortion. Therefore, an increase in cost due to the greater amount of labor required cannot be avoided. In addition, the removal of distortion is prolonged when the quenching distortion is large, and the cost of working is thereby further increased.

Furthermore, when carrying out the cutting work after the quench hardening, the cutting edge of the end mill used for the cutting work undergoes wear since the hardness of the tool body at the surface has been enhanced to no less than $H_RC$ 45, and in addition, the cutting accuracy is adversely affected. In particular, when working a plurality of insert-receiving recesses successively, the working precision is largely varied between the recess formed immediately after the commencement of the working and the recess formed at the end of the working. As a result, the run-outs of the inserts secured to the insert-receiving recesses are increased, so that the cutting accuracy is unduly deteriorated.

Furthermore, a great residual stress often occurs in the interior of the tool body due to the quenching during the hardening treatment, and the precision is lowered when such stress is later released.

SUMMARY OF THE INVENTION

It is therefore a primary object and feature of the present invention to provide a cutter which possesses great hardness at the surface of a tool body, thereby exhibiting excellent durability, and which possesses excellent precision as well.

Another object is to provide a manufacturing method by which the aforesaid cutter can be manufactured at a substantially reduced cost.

According to a first aspect of the present invention, there is provided a cutter comprising:

a tool body having a mounting portion to be secured to a machine tool and having a plurality of insert receiving recesses formed therein, the tool body having a nitrided hard layer formed on a surface thereof; and a plurality of cutter inserts each releasably attached to a respective one of the insert receiving recesses.

In the foregoing, when tapped holes are formed in the tool body for securing inserts or parts such as a wedge member or the like, it is preferable that the inner surfaces of the tapped holes be prevented from being subjected to nitriding to thereby define unnitrided portions. In addition, when forming a hard layer by means of nitriding treatment, a softer layer may be formed on the surface of the hard layer. In such a case, it is preferable that the softer layer be removed by subjecting the surface of the mounting portion to be secured to the tool machine to sanding work. Furthermore, in order to reduce the labor necessary for the manufacture of the tool body, it is preferable that the surfaces of the hard layers in the insert-receiving recesses be left as surfaces which are not finish-worked after the nitriding treatment. Moreover, it is preferable that the corner of each insert-receiving recess is chamfered or rounded in order to prevent cracks from appearing during the nitriding treatment.

Further, it is preferable that the hardness of the hard layer of the tool body be no less than 500 on the Vickers scale at portions 0.1 mm below the surface thereof.

According to another aspect of the invention, there is provided a method for producing a cutter which includes a tapped hole formed therein and having an inner surface defining an unnitrided portion, comprising the steps of:

(a) threading a plug into the tapped hole;

(b) subsequently subjecting the tool body to nitriding treatment to form a hard layer on the surface of the tool body; and (c) subsequently removing the plug from the tool body.

In this method, in order to reduce the manufacturing cost, it is preferable that the plug itself be formed of a material with resistance to nitriding, or that an unnitrided layer be formed on the surface of the plug before it is threaded into the tapped hole. Furthermore, in order to prevent the unnitrided portion from being larger than necessary, it is preferable that a tapered surface be formed at the open end of the tapped hole so as to taper inwardly of the tool body, and that a countersunk head screw having a tapered portion to be held in direct contact with the aforesaid tapered surface of the tapped hole is employed. In this connection, various screw members such as a hexagon headed bold, a set screw or the like may be used as the aforesaid plug.

In the cutter of the above construction, a sufficient hardness is imparted to the surface portion of the tool body by the hard layer formed by nitriding treatment. In addition, since the heating temperature for the nitriding treatment is far lower than the quench-hardening temperature of steel, the tool body is less susceptible to distortion. Therefore, the work to remove the distortion after the nitriding treatment is not required. Furthermore, inasmuch as residual stress does not occur during the nitriding treatment, the deterioration of the precision due to the subsequent release of the stress can be avoided. Particularly in the case of a tool body having a tapped hole, if the inner surface of the tapped hole is formed as a unnitrided portion, the hardnesses of the threads of the tapped hole are prevented from increasing unduly, so that fracturing or chipping of the threads, as well as the damage of the mating screw, can be avoided.

Moreover, by removing the softer layer from the mounting portion of the tool body by sanding, the mounting portion can be prevented from being deformed when the cutter is secured to the tool machine, and hence the reproducibility of the securing precision can be enhanced. In contrast, when the surface of the hard layer in the insert-receiving recess is left as a surface which is not finish-worked after the nitriding treatment, the finish-working after the nitriding treatment itself can be omitted, and in particular, the necessary labor can be substantially reduced in the case of an insert cutter provided with a number of insert-receiving recesses. Furthermore, when the corner of the insert-receiving recess is chamfered or rounded, stress is prevented from being concentrated at the corner, so that the occurrence of cracking in the hard layer can be prevented.

Moreover, with the above manufacturing method, the tapped hole is sealed by the plug threaded thereinto, and hence a nitriding agent such as ammonia gas, or a nitriding solution, can be prevented from entering the tapped hole during the nitriding treatment, and therefore the unnitrided portion can be easily formed simply by unthreading the plug after the nitriding treatment. In addition. If a nitriding-retardant agent is applied in the tapped hole to prevent the nitriding, the agent may adhere to those portions which are not intended to be unnitrided portions. However, when the aforesaid plug is used, such a disadvantage can be avoided. In addition, the problems caused by uneven application of the nitriding-retardant agent can also be avoided, so that an unnitrided portion of a uniform quality can be obtained.

Furthermore, in the case where a material with resistance to nitriding is used, or in the case where the nitriding treatment is carried out by forming the unnitrided portion on the surface of the plug, the plug itself will not be deteriorated before and after the nitriding treatment, and hence the plug can be employed repeatedly to thereby reduce the cost required for the nitriding treatments.

Moreover, in the case where the tapered surface is formed at the open end of the tapped hole of the tool body and a countersunk head screw is used as the plug, the tapered face of the head portion of the countersunk head screw is brought into intimate contact with the tapered surface of the tapped hole. Therefore, the sealing performance of the plug can be improved, and hence the resulting unnitrided portion comes to have higher quality. In addition, since the nitriding-retardant agent definitely covers the periphery of the open end of the tapped hole, the nitriding hard layer can be formed up to the bounds of the periphery of the tapped hole, so that the unnitrided portion is not formed outside the intended area.

BRIEF DESCRIPTION OF THE DRAWINGS

FIG. 15(*b*) is a view similar to FIG. 15(*a*), but showing the wedge member after the nitriding treatment;

FIG. 27(*b*) is a plan view of the wedge member of FIG. 26;

FIG. 27(*c*) is a front elevational view of the wedge member of FIG. 26;

FIG. 29(*b*) is a plan view of the wedge member of FIG. 28;

FIG. 29(*c*) is a front elevational view of the wedge member of FIG. 28;

FIG. 30(*b*) is a graphical representation showing the surface roughnesses of the front face of the prior art wedge member measured prior to the cutting test;

FIG. 31(*b*) is a view similar to FIG. 30(*b*), but showing the surface roughness after the cutting test.

DESCRIPTION OF THE PREFERRED EMBODIMENTS OF THE INVENTION

Figure 1:
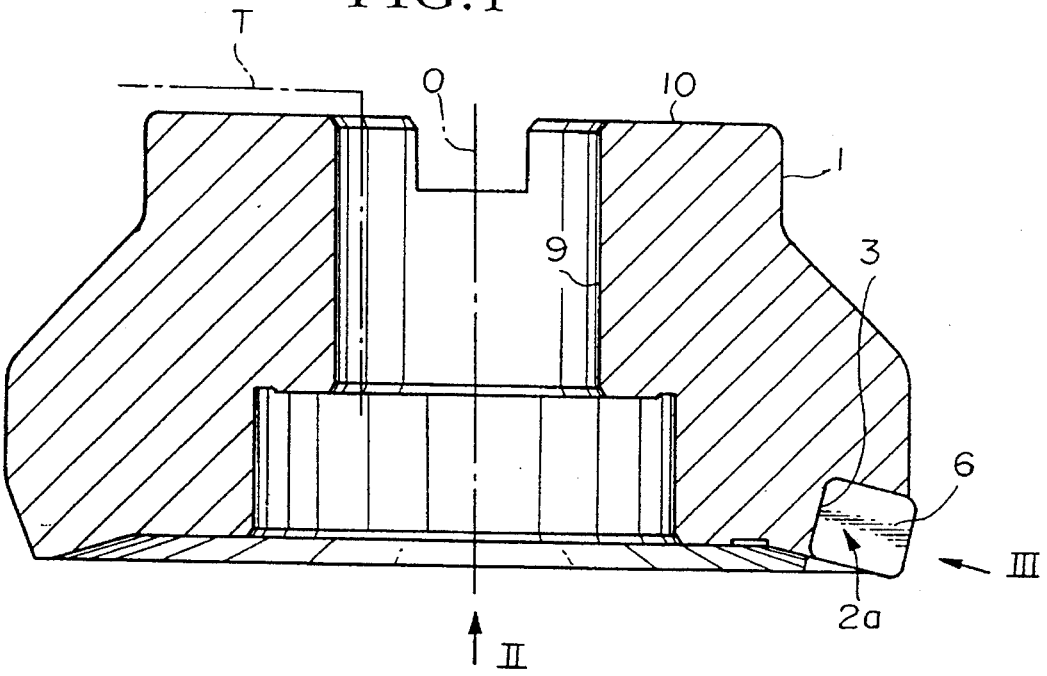
FIG. 1 is a cross-sectional view of a cutter in accordance with an embodiment of the present invention.

FIGS. 1 to 4 depict an insert face milling cutter in accordance with an embodiment of the present invention, which comprises a tool body 1 including a plurality of chip pockets 2 formed in its outer peripheral surface in circumferentially equally spaced relation to one another. An insert-receiving recess 2*a*, which has an insert-receiving seat 3 facing in a circumferential direction of rotation of the body 1, is formed in each of the chip pockets 2, and a tetragonal plate-like seat member 4 is received on the insert-receiving seat 3 and is secured thereto by means of a set screw 5. Furthermore, a cutter insert 6, which is formed by shaping a cemented carbide into a generally square plate-like shape, is received on the seat member 4, and is firmly secured to the tool body 1 with its front face being pressed by a wedge member 8 which is received in the insert-receiving recess 2*a* and is secured thereto by a clamp screw 7. Moreover, the tool body 1 has a central bore 9 formed so as to extend coaxially therewith, and the end face surrounding the rearward open end of the central bore 9 defines a boss surface 10 perpendicular to the axis of the tool body 1. The central bore 9 and the boss surface 10 define mounting portions for securing the tool body 1 to a spindle of a tool machine (not shown).

The tool body 1 is formed by shaping a steel such as JIS: SCM440, SNCM 439 or the like into a cylindrical shape and subjecting it to cutting work to form the aforesaid insert-receiving recesses 2*a*, the central bore 9 and the boss surface 10. The tool body 1 is subjected to nitriding treatment over an entire surface thereof, whereby a hard layer (not shown) harder than an interior portion is formed on the surface of the tool body 1. The hardness of the hard layer may be determined appropriately based on the conditions for the use of the tool or the hardness of the interior portion, but should preferably be no less than 500 on the Vickers hardness scale at a portion 0.1 mm under the surface. If the hardness is less than $H_V$ 500, the difference in hardness between the hard layer and the interior portion is too small to improve the tool life.

Furthermore, for the nitriding treatment of the tool body 1, any known methods may be employed. For example, a gaseous nitriding method, which involves heating the tool body 1 in an atmosphere of ammonia gas ($NH_3$) or another gaseous atmosphere containing nitrogen, to cause nitrogen atoms to penetrate from the surface of the tool into the tool body, is preferably applied. Otherwise, a salt bath nitriding method, which involves heating the tool body 1 while keeping it in a mixed solution of cyanide (KCN, NaCN) and cyanate (KCNO, NaCNO), or an ion-nitriding method may be applied.

In the foregoing, the temperature of the tool body 1 at the nitriding treatment is from 500° to 550° C. for the gas nitriding method, and less than 600° C. even in the salt bath nitriding method. These temperatures are far lower than the temperature used during the quench hardening, which exceeds 850° C. In addition, the time required for the nitriding treatment is from 20 to 100 hours in the gaseous nitriding method and from 2 to 3 hours in the salt bath nitriding method. Furthermore, it is preferable that the depth of the hard layer range from 0.1 mm to 0.4 mm. If the depth is no greater than 0.1 mm, the hardness may be easily diminished since the hard layer is too thin. On the other hand, if the thickness exceeds 0.4 mm, cracking may occur since the hardness at the surface is unduly increased. In order to obtain this thickness, the processing time in the gaseous nitriding method should be preferably set to 20 to 40 hours.

Moreover, the insert-receiving recesses 2*a*, the central bore 9 and the boss surface 10 are formed with a prescribed precision by cutting work or grinding work before the nitriding treatment. However, during the nitriding treatment, carbon in the tool body 1 may be sometimes combined with the nitrides to form a softer layer on the surface of the tool body 1. In this case, after the nitriding treatment, the mounting portions to be secured to the tool machine (the portions indicated by dashed line T in FIG. 1), which include the boss surface 10 and the central bore 9, may be subjected to sanding work to cause the surface of the hard layer to become a sanded surface without the softer layer. If the softer layer on the surface of the mounting portions is left as it is, it will be deformed when the tool body 1 is secured to the tool machine, and errors such as displacement of the central axis may occur during the securing procedures. Therefore, a sufficient securing precision of the tool body 1 cannot be ensured. In this connection, the thickness of the film of this softer layer is about 0.01 mm at the maximum, and the sanding margin or thickness for the removal of the film is about 0.05 mm at maximum.

Furthermore, in the milling cutters, the number of the insert-receiving recesses 2*a* is large, so that it is not appropriate to finish-work these recesses one by one due to the amount of labor this would require. Accordingly, the surfaces of the hard layers formed on the insert-receiving recesses 2*a* of the tool body 1 are left as surfaces without being finish-worked after the nitriding treatment.

Figure 2:
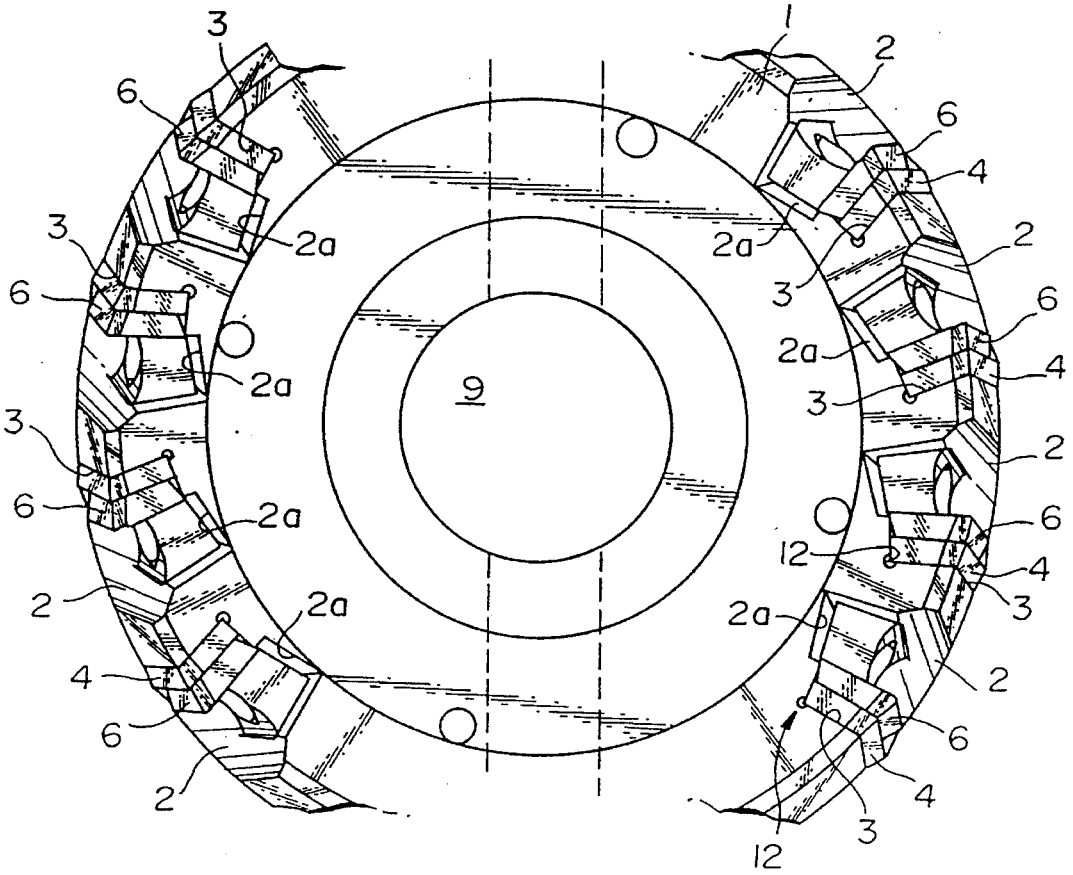
FIG. 2 is an end view of the cutter of FIG. 1 as seen in the direction indicated by the arrow II in FIG. 1.
Figure 3:
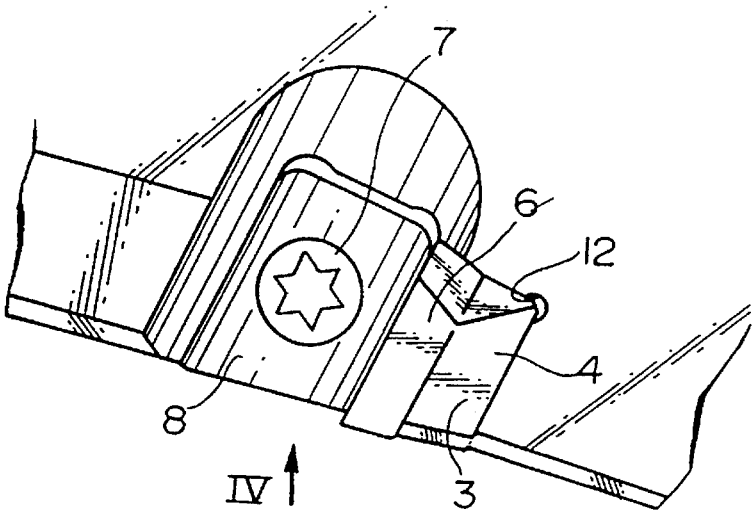
FIG. 3 is a side-elevational view of a part of the cutter of FIG. 1, as seen in the direction indicated by the arrow III in FIG. 1.
Figure 4:
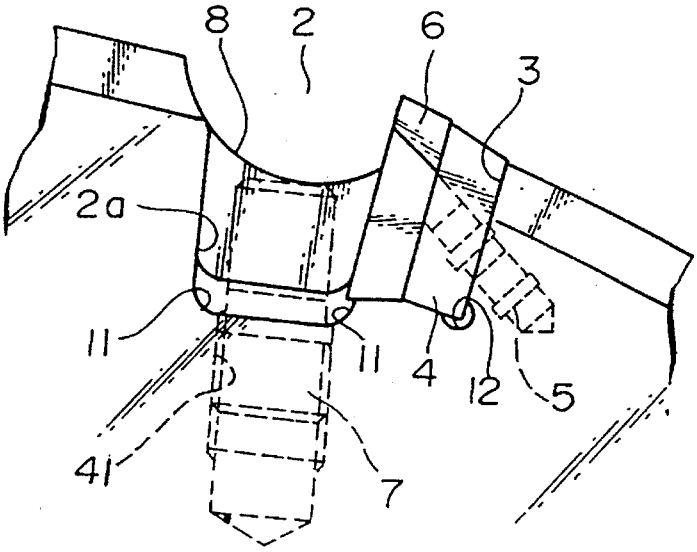
FIG. 4 is a view as seen in the direction indicated by the arrow IV in FIG. 3.

Furthermore, as best shown in FIGS. 2 to 4, the corners of each insert-receiving recess 2*a* into which the adjacent walls thereof merge are rounded to define small curved surfaces 11 and 12. These curved surfaces 11 and 12 prevent the occurrence of cracking during the nitriding treatment to thereby guard the hard layer. Instead of the provision of these curved surfaces 11 and 12, the corners of each insert-receiving recess 2*a* may be chamfered to define small inclined surfaces which intersect the adjacent walls in an oblique manner.

In the face milling cutter as constructed above, a sufficient hardness is imparted to the surface of the tool body 1 by the nitriding treatment. In addition, since the nitriding temperature is far lower than the quench hardening temperature, distortion can be prevented from occurring at the portions requiring high precision, such as the central bore 9, the boss surface 10 or the insert-receiving recesses 2*a*. For this reason, the finish work after the nitriding treatment can be omitted, and the labor and time for the manufacture of the tool body are greatly reduced, so that a substantial reduction in the manufacturing cost can be attained. Furthermore, even in the case where it is necessary to work the boss surface 10 and the like after the nitriding treatment in order to remove the softer layer formed during the nitriding, the thickness removed is much less than compared with the case of removing the distortion on after the quench hardening, so that an increase of the manufacturing cost can be avoided. In this connection, the thickness removed only 0.05 mm, although that for the quench hardening is more than 0.2 mm, and hence the time required for the subsequent working is far shorter. Furthermore, since the nitriding temperature is low, residual stress does not occur in the tool body 1, so that the deterioration of precision due to the subsequent release of the stress can be avoided. Moreover, since it is not necessary to finish-work the insert-receiving recesses 2*a* after the nitriding treatment, the increase of the run-outs caused by the wearing of the tool used for the finish-working can be avoided.

Figure 5:
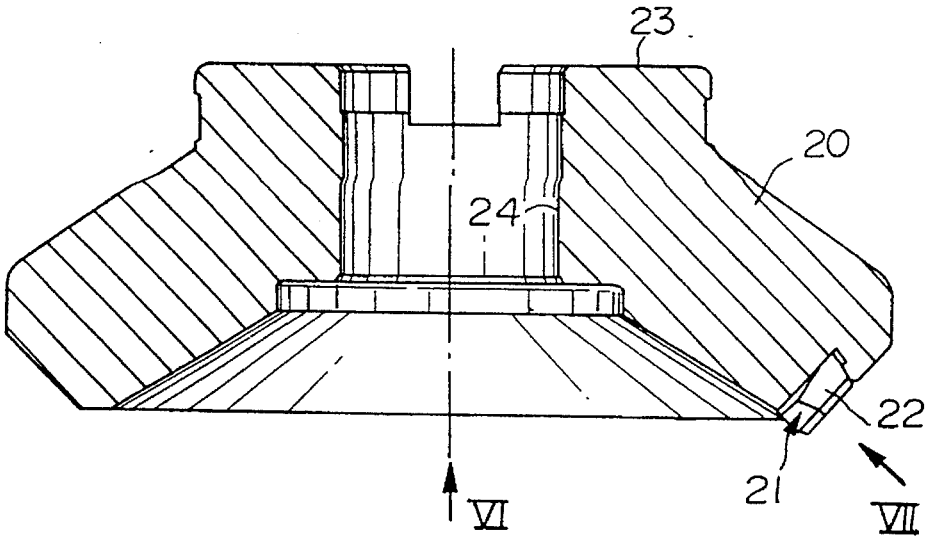
FIG. 5 is a cross-sectional view of a cutter in accordance with another embodiment of the present invention.
Figure 6:
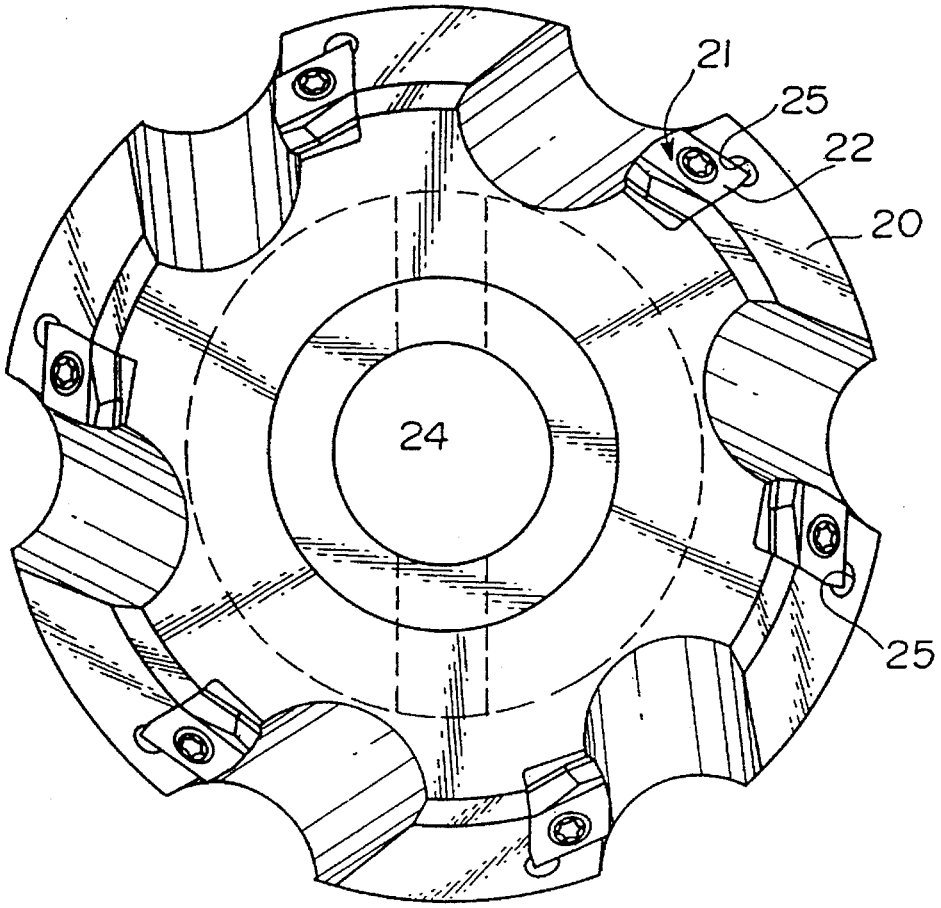
FIG. 6 is an end view of the cutter of FIG. 5 as seen in the direction indicated by the arrow VI in FIG. 5.
Figure 7:
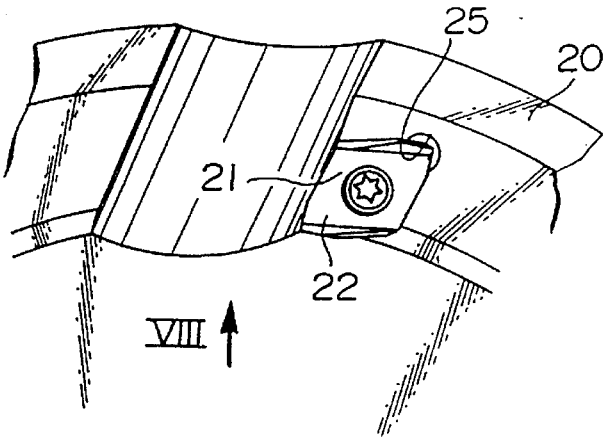
FIG. 7 is a view of the cutter of FIG. 5, as seen in the direction indicated by the arrow VII in FIG. 5.

In the foregoing, a face milling cutter, in which each cutter insert is secured to the tool body with its front and rear faces being directed circumferentially of the body, has been taken as an example to explain the present invention, but the invention is never limited to the milling cutters of this type. For example, FIGS. 5 to 7 depict a milling cutter with longitudinal tooth, i.e., a milling cutter in which each cutter insert 22 is attached to an insert-receiving recess 21 of a tool body 20 with its side faces being directed circumferentially of the tool body. The present invention may be applied to this tool, and the same advantageous effects can be obtained by forming a boss surface 23, a central bore 24 and insert-receiving recesses 21 at a prescribed precision and subsequently subjecting the tool body 20 to nitriding treatment to form a hard layer. In this type of milling cutter, too, the development of cracking can be prevented by rounding the corner to define a small curved portion 25 or by chamfering the corner.

Figure 9:
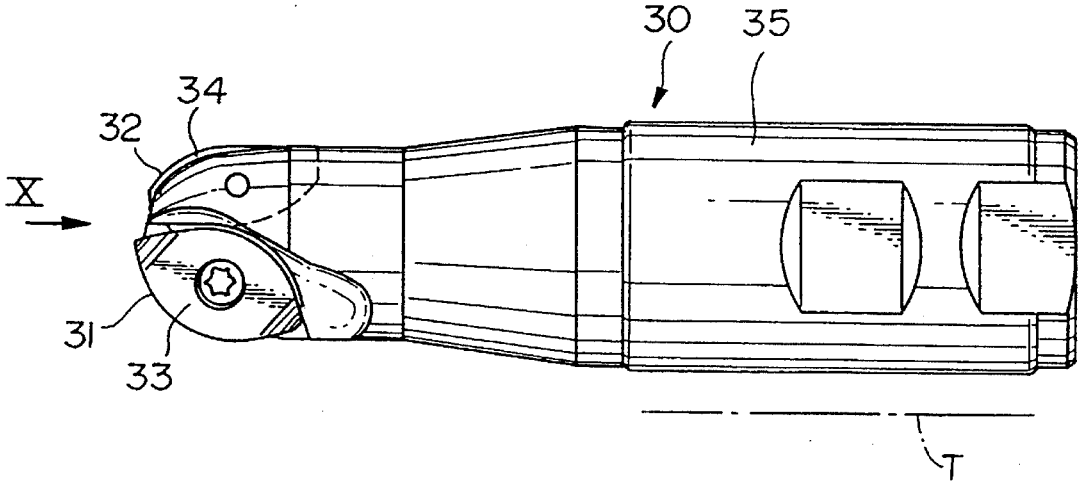
FIG. 9 is a side-elevational view of a cutter in accordance with yet another embodiment of the present invention.
Figure 10:
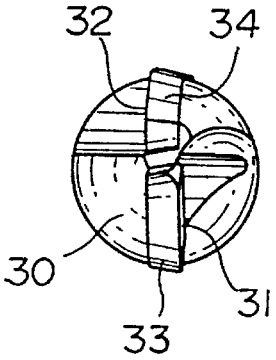
FIG. 10 is an end view of the cutting tool of FIG. 9 as seen in the direction indicated by the arrow X in FIG. 9.

In addition, the invention may be applied to a ball-nose end mill which, as shown in FIGS. 9 and 10, includes a cylindrical tool body 30 and cutter inserts 33 and 34 having arcuately curved cutting edges 31 and 32, respectively. In this embodiment, as are the cases with the boss surface, the central bore and the like for the milling cutter, it is preferable that the surface of a shank portion 35 (indicated by the dashed line T in FIG. 9) is formed into a sanded surface free from the softer layer. Furthermore, the present invention may be applied to various insert cutters of the other types.

Figure 8:
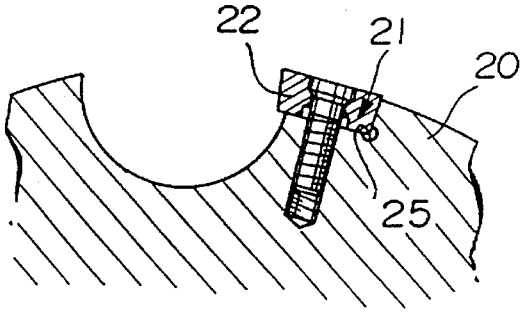
FIG. 8 is a view as seen in the direction indicated by the arrow VIII in FIG. 5.

Incidentally, as shown, for example, in FIG. 4 or FIG. 8, the tool bodies 1, 20 and 30 of the tools as explained above have tapped holes 40, 41, 42 for securing parts such as cutter inserts 6, 22, 33, 34 or seat members 4. If the nitriding treatment is carried out up to the inner portions of these tapped holes 40 to 42, the hardnesses of the threads are unduly increased, and the toughnesses are deteriorated. When the screws 5, 7 and 26 are threaded and unthreaded repeatedly, their threads come to be fractured or chipped, while the screws 5, 7 and 26 themselves may also be damaged by the hard threads. Therefore, it is preferable that the interior portions of these tapped holes 40 to 42 are formed as unnitrided portions which are prevented from undergoing the nitriding.

For forming the unnitrided portions in the tapped holes 40 to 42, the inner surface of each tapped hole may be coated with a known nitriding-retardant agent. However, inasmuch as the agent is liquid, it is difficult to accurately apply it only on the necessary portions, and the unnitrided portion may be unnecessarily spread due to the excessive application area, or a uniform nitriding-preventing effect cannot be attained due to the uneven application of the agent. Furthermore, when the nitriding-retardant agent inadvertently adheres unnecessary portions of the tool bodies 1, 20 and 30, desired hard layers sometimes cannot be obtained. Further, if the nitriding-retardant agent is left in the interiors of the tapped holes 40 to 42, a smooth turning movement of the screws 5, 7 and 26 may be prevented.

Figure 11:
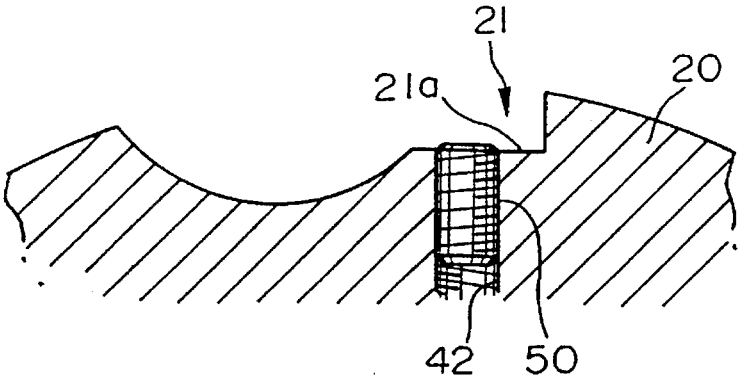
FIG. 11 is a cross-sectional view showing an insert receiving recess, for explaining an embodiment of a manufacturing method of the invention.
Figure 12:
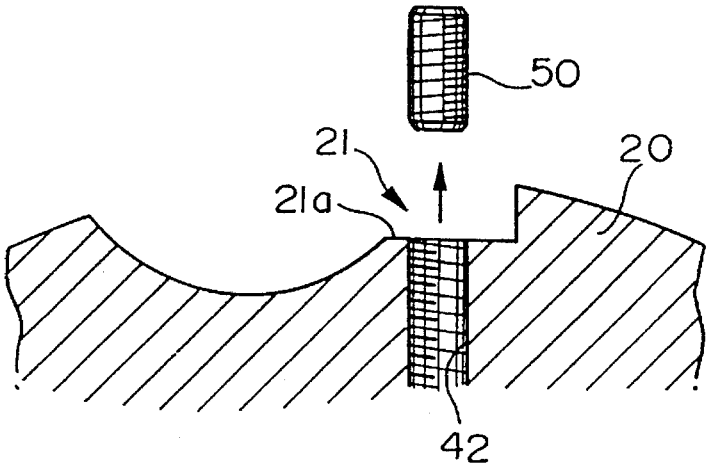
FIG. 12 is a view similar to FIG. 11, but showing the state in which a plug is removed from the tool body.

Accordingly, for forming the unnitrided portion, it is preferable that as shown in FIG. 11, a set screw (plug) 50 be threaded into the tapped hole 40 to 42 (only the tapped hole 42 is shown) prior to the nitriding treatment to thereby seal the tapped hole 40 to 42. Then, the nitriding treatment is carried out to form a hard layer on the surface of the insert-receiving recesses 21 or the like. Subsequently, as shown in FIG. 12, the set screw 50 is removed from the tapped hole 40 to 42. With this method, since the tapped hole 40 to 42 is effectively sealed by the set screw 50, the nitriding agent such as ammonia gas is prevented from entering the tapped hole 40 to 42, so that the unnitrided portion can be easily obtained. In addition, since the coating of the nitriding-retardant agent is not required, the unnitrided portion is not formed on a portion other than the interior portion of the tapped hole 40 to 42. Furthermore, the unevenness of the nitriding-preventing effects due to the uneven coating of the nitriding-retardant agent can be avoided.

In the foregoing, in the embodiment shown in FIGS. 11 and 12, if the set screw 50 is formed of a material with resistance to nitriding, such as copper, brass or the like, the set screw 50 is not subjected to nitriding during the nitriding treatment, and hence the set screw 50 can be used repeatedly, to thereby reduce the cost required for the nitriding. In this case, it is natural that a material with resistance to nitriding which can withstand high nitriding treatment temperature of 500° C. to 600° C. must be properly selected. Furthermore, even when the set screw 50 is formed of a material which is susceptible to nitriding, such as a steel, the nitriding of the set screw 50 can be prevented by nickel-plating its surface, or by coating a nitriding-retardant agent to define an unnitrided portion thereon.

Figure 13:
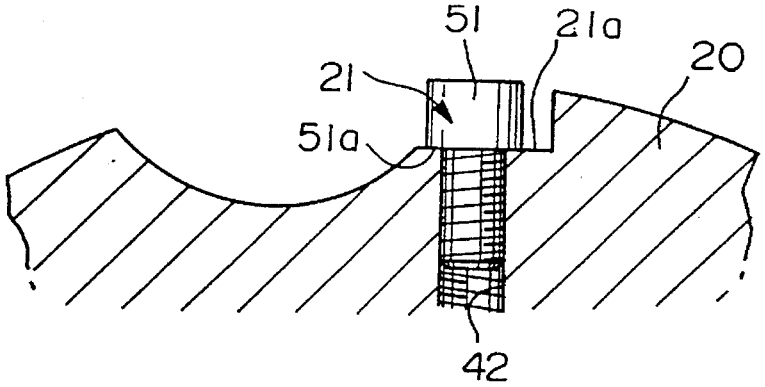
FIG. 13 is a cross-sectional view similar to FIG. 11, but showing a modification of the embodiment shown in FIG. 11.

Furthermore, although in the embodiment of FIGS. 11 and 12, a set screw 50 is used as the plug, a hexagonal socket head cap screw 51 as shown in FIG. 13, or other conventional headed bolts such as a hexagonal headed bolt may be employed. In this case, since an end face 51*a* of the head of the bolt 51 is held in direct contact with the bottom 21*a* of the insert-receiving recess 21, the sealing performance of the tapped hole can be further enhanced, so that the nitriding can be positively prevented.

Figure 14:
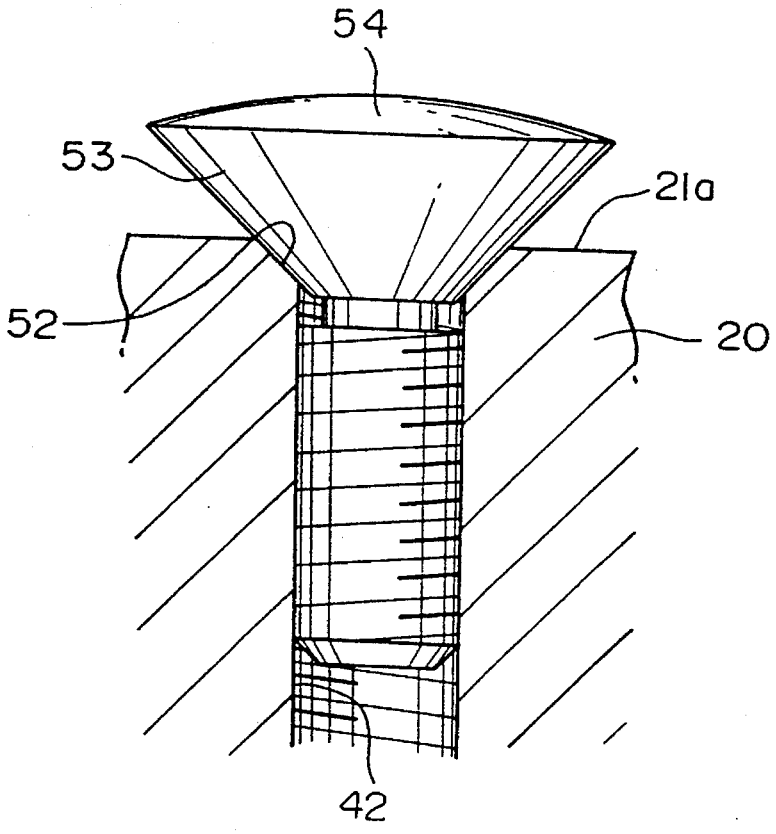
FIG. 14 is a cross-sectional view showing another modification of the embodiment in FIG. 11.

In this connection, in the embodiment shown in FIG. 13, the nitriding agent does not contact that portion of the bottom 21*a* of the insert-receiving recess 21 which is held in contact with the end face 51*a* of the bolt head, so that the unnitrided portion is caused to spread slightly around the open end of the tapped hole. Therefore, for preventing the unnitrided portion from spreading while maintaining the sealing performance of the tapped holes 40 to 42, it is preferable that, as shown in FIG. 14, a tapered surface 52 tapering in a direction away from the open end of the tapped hole 40 to 42 is formed at the open end of the tapped hole 40 to 42, and that a flat head screw 54 having a tapered portion 53 to be held in direct contact with the tapered surface 52 is used as the plug. According to this embodiment, since the tapered portion 53 of the flat head screw 54 and the tapered surface 52 of the tapped hole 40 to 42 are held in intimate contact with each other, the sealing performance of the tapped holes 40 to 42 can be enhanced, so that the prevention of nitriding can be positively ensured. In addition, the bottom 21*a* of the insert-receiving recess 21 is not brought into contact with the flat head screw 54, and the periphery of the open end of the tapped hole 40 to 42 is left free. Therefore, when a nitriding agent such as ammonia gas reaches the bounds of the open end of the tapped hole 40 to the unnitrided portion can be prevented from spreading unnecessarily.

FIGS. 15 to 18 depict a face milling cutter in accordance with a further embodiment of the present invention which differs from the previous embodiments only in that a clamp member such as the wedge member 68 is further modified. More specifically, the milling cutter comprises a tool body 61 having a central bore 61*a* and a plurality of chip pockets 62. A wedge-receiving recess 63 and an insert-receiving-recess 64 are formed in each of the chip pockets 62, and an insert 66 is received on the insert-receiving recess 64 with a seat member 65 interposed therebetween. The insert 66 is pressed circumferentially of the body 61 by the wedge member 68 and firmly secured to the tool body 61, the wedge member 68 being received in the wedge-receiving recess 63 and sectored thereto by a clamp screw 67. In the drawing, the numerals 66*a* and 66*b* denote a main cutting edge and an auxiliary cutting edge, respectively.

Figure 16:
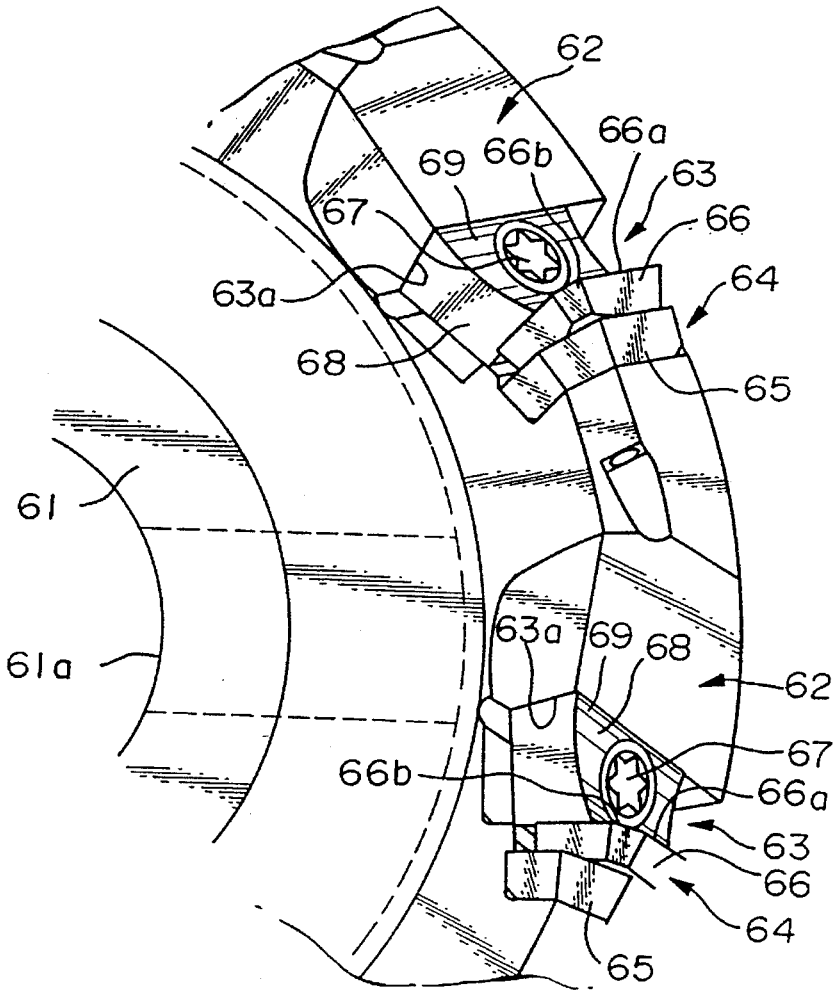
FIG. 16 is an end view of a face milling cutter in accordance with a further embodiment of the invention, in which the wedge member of FIGS. 15(*a*) and 15(*b*) is used.
Figure 17:
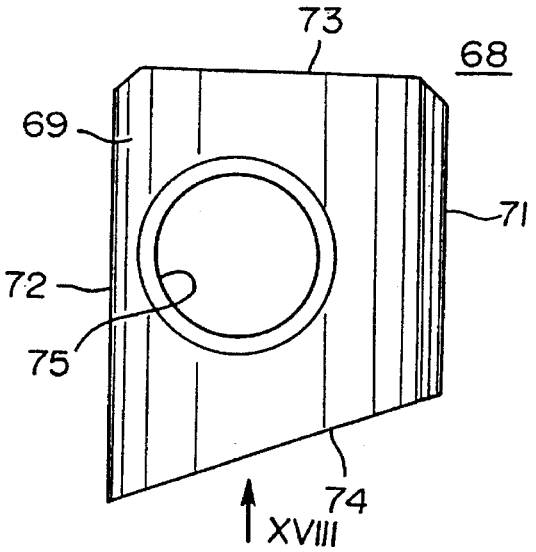
FIG. 17 is a plan view of the wedge member of FIGS. 15(*a*) and 15(*b*)
Figure 18:
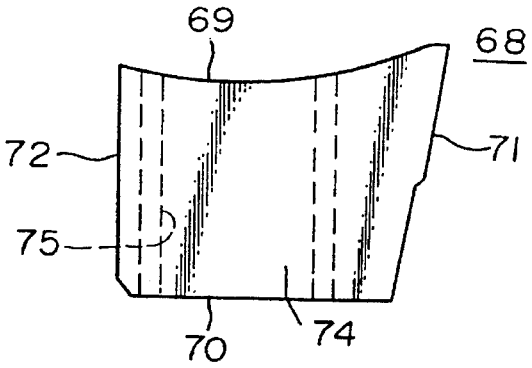
FIG. 18 is a view as seen in the direction indicated by the arrow XVIII in FIG. 17.

As shown in FIGS. 16 to 18, the wedge member 68 is defined by a front face 69, a rear face 70 and four side faces 71 to 74 lying between the front and rear faces 69 and 70, and includes a tapped hole 75 or an internally threaded aperture with which the clamp screw 67 is held in threading engagement. The side face 71 which is to be held in abutting contact with the rake surface of the insert 66 is formed so as to be inclined at a prescribed angle with respect to the axis of the tapped hole 75, while the side face 72 which is held in intimate contact with the wall 63*a* of the wedge-receiving recess 63 is formed so as to be parallel to the axis of the tapped hole 75. The reason the side face 74 positioned at the lower side in FIG. 17 is inclined with respect to the opposite side face 73 is that the side face 14 must be flush with the surface of the tool body 61 when the wedge member 68 is secured to the wedge-receiving recess 63.

The front face 69 of the wedge member 68 is formed into a curved surface of an arcuate cross-section which is continuous with the wall of the chip pocket 62, and thus the front face 69 defines a contact surface with which cutting chips produced by the main cutting edge 66*a* and the auxiliary cutting edge 66*b* are held in frictional contact. The procedures of the formation of the hard layer are quite different from the prior art method, and hence its construction is also different from the prior art. Hereinafter, the construction of the wedge member 68 as well as the procedures of the formation of the hard layer will be described with reference to FIG. 15.

Figure 15A:
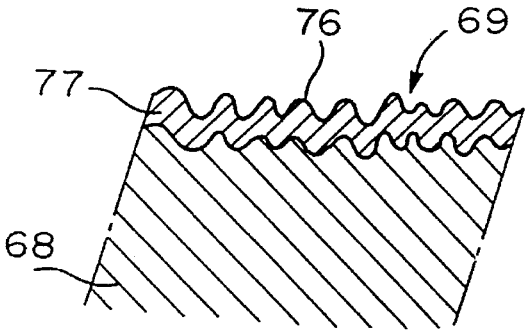
FIG. 15(*a*) is an enlarged cross-sectional view of a surface portion of a wedge member prior to nitriding treatment.
Figure 15B:
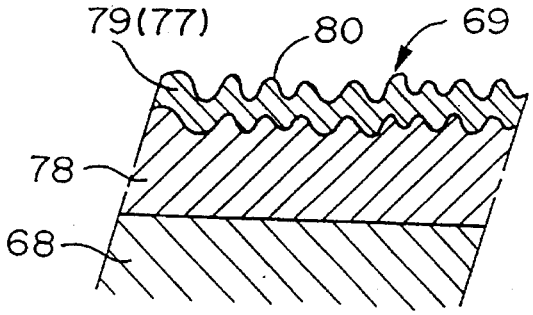

As shown in FIG. 15(*a*), the front face 69 of the wedge member 68 is formed into a precision-cast face or case 76. This case 76 is defined by an uneven surface of small irregularity which is round, i.e., an uneven surface in which apexes of the protrusions are not acute but are rounded, and a decarburized layer 67 exists at an outermost portion thereof. The decarburized layer 67 usually has a thickness of about 0.1 mm, and has the property that its hardness does not increase even when subjected to quench hardening. Therefore, the decarburized layer 77 is usually removed by grinding work during the formation of the front face 69. However, in the present embodiment, the decarburized layer 77 is left as it is.

In the foregoing, various steels may be used to manufacture the wedge member 68, and in the illustrated embodiment, chromium-molybdenum steel (JIS: SCM440) having a hardness $H_RC$ of about 30 to 55 is used. Furthermore, in order to obtain the case 16 by means of precision casting, the wedge member 68 may be manufactured by precision-casting one by one, or an ingot of a cross-section having the same curved surface as the front face 69 may be cast and cut into wedge members 68.

The front face 69 which is left as the precision-cast unglazed surface 16 is then subjected to nitriding treatment, which is similar to those mentioned before. With the nitriding treatment, a prescribed hard layer 78 is formed on the front face 69. In this connection, a compound layer 79 having a thickness of about 0.01 to 0.05 mm is formed on the outermost portion of the hard layer. This compound layer 79 has the property that its frictional resistance is low and has a high lubricity, and is formed even when the aforesaid decarburized layer 77 exists. In addition, since the thickness of the compound layer 79 is smaller than that of the decarburized layer 77 obtained by precision-casting, the compound layer 79 is formed within the decarburized layer 77, and only the hard layer 78 exists under the decarburized layer 77. Furthermore, the surface of the compound layer 79 defines a rounded uneven face of irregularity in conformity with that of the precision-cast unglazed surface 76.

After the formation of the hard layer 78, the front face 69 is left as it is, without being subjected to the removal works of the compound layer 79. Thus, the outermost surface portion of the front face 69 serves as a surface 80 which is not finish-worked even after the nitriding treatment. Accordingly, at the final stage of the manufacture of the front face 69, the surface portion of the front face 69 is defined by the uneven surface 80, the compound layer 79 included in the decarburized layer 77, and the hard layer 78 obtained by the nitriding.

In the foregoing, the rear face 70 and the side faces 71 to 74 of the wedge member 68 need not be prevented from undergoing the nitriding, and the finish-work may be carried out as necessary after the nitriding treatment. However, when the finish-working of these faces after the nitriding treatment is omitted, the labor in the manufacture of the wedge member 68 can be naturally reduced.

In the wedge member 68 as constructed above, the compound layer 79, which has a low frictional resistance and has a high lubricity, is formed on the surface portion of the front face 69, and its surface is formed into the surface 80 which is rounded and uneven. As a result, the frictional resistance of the front face 69 is reduced, and the contact area between the front face 69 and the cutting chips is reduced, so that the frictional resistance caused by the cutting chips can be substantially reduced. Therefore, the damage of the front face 69 due to the frictional engagement with the cutting chips can be further prevented. In addition, since the surface of the compound layer 79 is uneven, the surface area is increased. Therefore, heat can be easily dissipated, and high frictional heat is not accumulated. Furthermore, pores are formed during the formation of the compound layer 79 to increase the unevenness, and the surface area of the front face is increased, thereby further enhancing the dissipating effect of the frictional heat. Accordingly, the wedge member 68 is not damaged by thermal fatigue, so that the durability of the wedge member 68 can be substantially enhanced.

In the foregoing, the compound layer 79 is low in hardness as compared with the hard layer 78, so that the layer may be worn after the use of a prescribed period of time. However, even though the compound layer 79 is worn off, the hard-layer 78 exists thereunder, and hence the wedge member 68 can be used for a prolonged period.

Figure 19:
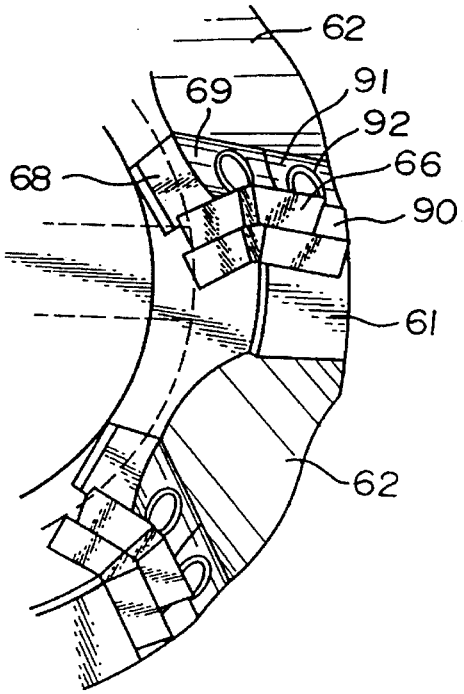
FIG. 19 is a face milling cutter in accordance with yet a further embodiment of the invention.
Figure 20:
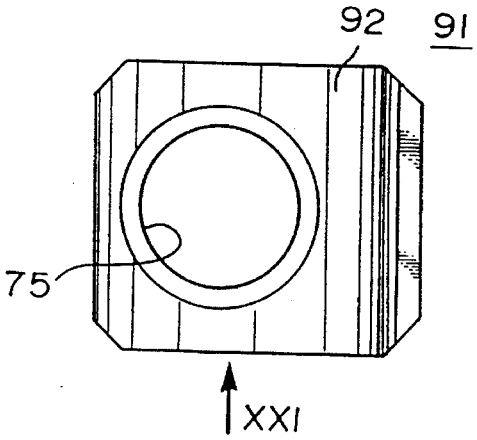
FIG. 20 is a plan view showing a wedge member used in the cutter of FIG. 19.
Figure 21:
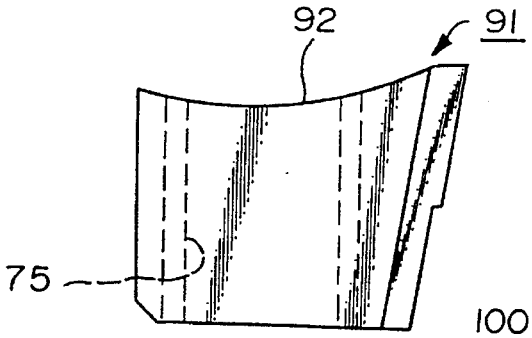
FIG. 21 is a view as seen in the direction indicated by the arrow XXI in FIG. 20.

In the above embodiment, the wedge member 68 is modified, but another kind of clamp member may be similarly modified. For example, FIG. 19 depicts a face milling cutter in which an insert 66 received in a support member 90 is pressed by the wedge member 68, and the support member 90 itself is pressed by another wedge member 91. In this tool, a front face 92 of the wedge member 91 serves as a chip-contacting surface which is continuous with the wall of the chip pocket 62, and hence the front face 92 is formed so as to have the same construction as the front face 69 of the aforesaid wedge member 68.

Figure 22:
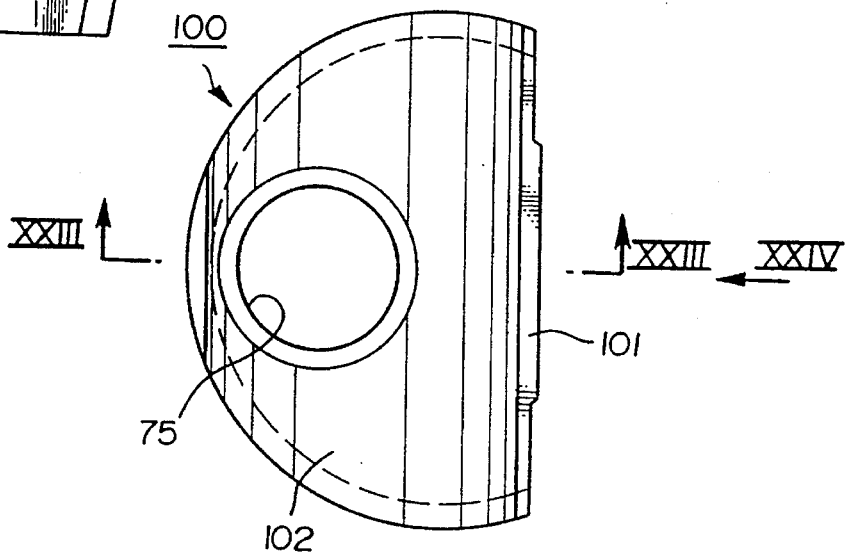
FIG. 22 is a plan view of a modified wedge member.
Figure 23:
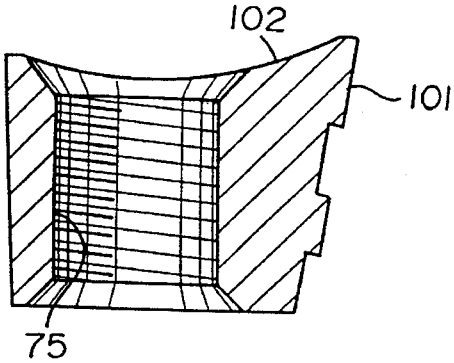
FIG. 23 is a cross-sectional view taken along the line XXIII—XXIII in FIG. 22.
Figure 24:
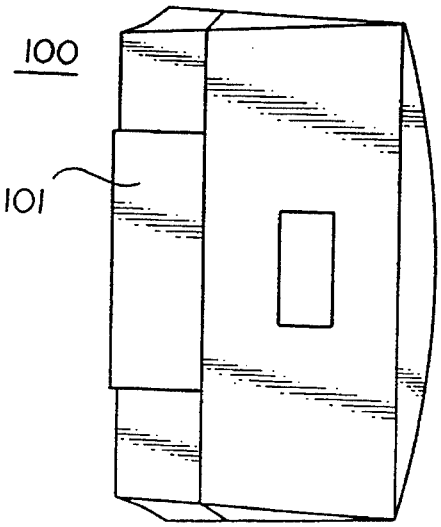
FIG. 24 is a view as seen in the direction indicated by the arrow XXIV in FIG. 22.

Furthermore, although in the embodiment shown in FIGS. 15 to 18, the wedge member 68 is of a generally square shape as viewed in plan, its shape is not limited to this. For example, as shown in FIGS. 22 to 24, a wedge member 100 of a semi-circular shape as viewed in plan may be used. In this embodiment, that side face which corresponds to the chord portion of the semi-circle serves as a surface to be held in contact with the insert, while a front face 102 serves as a chip-contacting surface, and the surface portion of the front face 102 is constructed in the same manner as in the previous embodiments.

Moreover, the modification may be-made as to a clamp block for securing the insert in an insert turning tool. In this case, the rear face of the forward end portion of the clamp block serves as a surface to be held in contact with the insert, while the front face of the forward end portion of the clamp block serves as a chip-contacting surface, which is to be subjected to nitriding.

The present invention will be hereinafter described in more detail by way of the following examples.

Example 1

Figure 25:
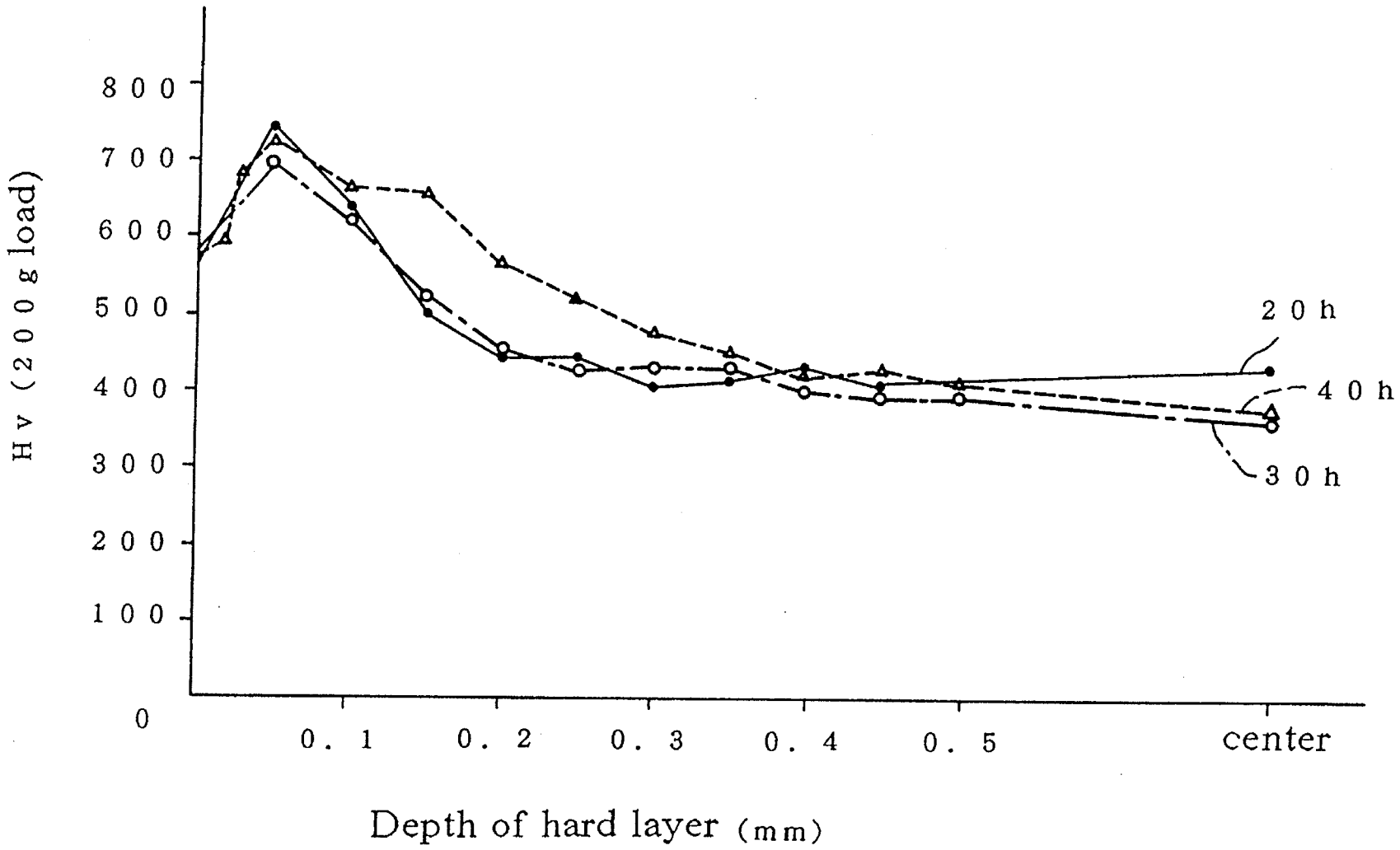
FIG. 25 is a graphical representation showing the relationship between the depth of nitrided layer and the hardness.

A tool body of a face milling cutter as shown in FIGS. 1 to 4 was actually manufactured, and its hardness was measured. The results are shown in FIG. 25. In the manufacture, a gaseous nitriding method using ammonia gas was applied, and a steel JIS: SCM440 was selected as the material for the tool body, in addition, the nitriding duration was changed in three stages of 20 hours, 30 hours and 40 hours.

As will be seen from FIG. 25, in spite of the various nitriding times, the maximum hardness is always obtained at a portion 0.05 mm under the tool surface, and the hardness decreases inwardly of the tool body up to a position 0.4 mm deep from the tool surface, below which no difference is recognized as compared with the interior portion. Accordingly, in order to ensure a hard layer at the tool surface for sure, it is preferable that the thickness of the hard layer be no less than 0.1 mm. Furthermore, it has been found that even if the nitriding time is prolonged, it is difficult to obtain a hard layer of no less than 0.4 mm thick, and it is only the surface portion that comes to have great hardness. Accordingly, the thickness of the hard layer should preferably be no greater than 0.4 mm.

Example 2

Figure 26:
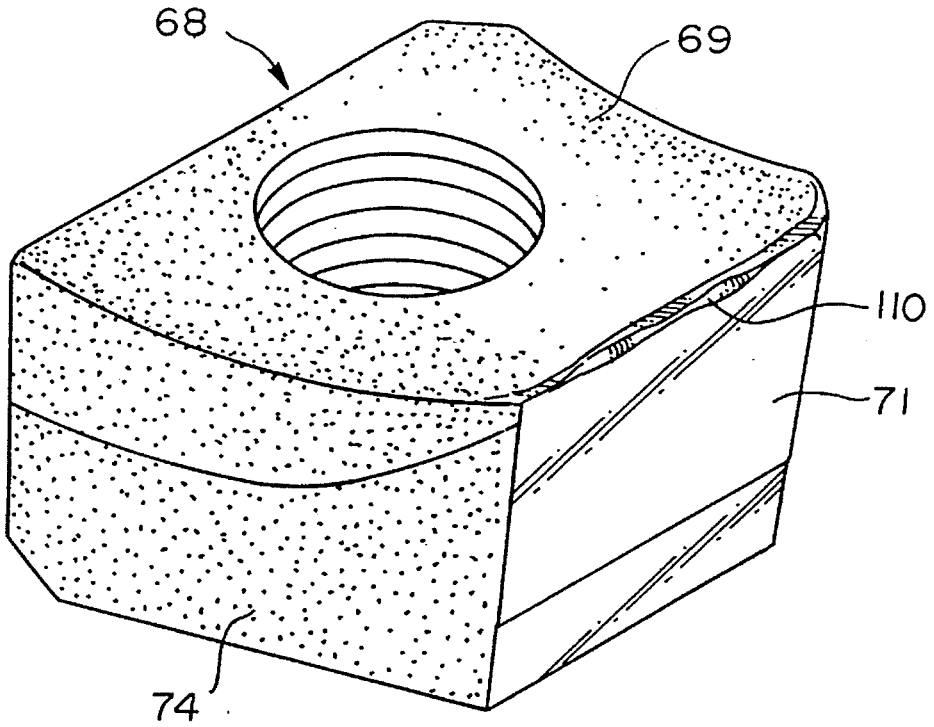
FIG. 26 is a perspective view showing an improved wedge member which was subjected to a cutting test.
Figure 28:
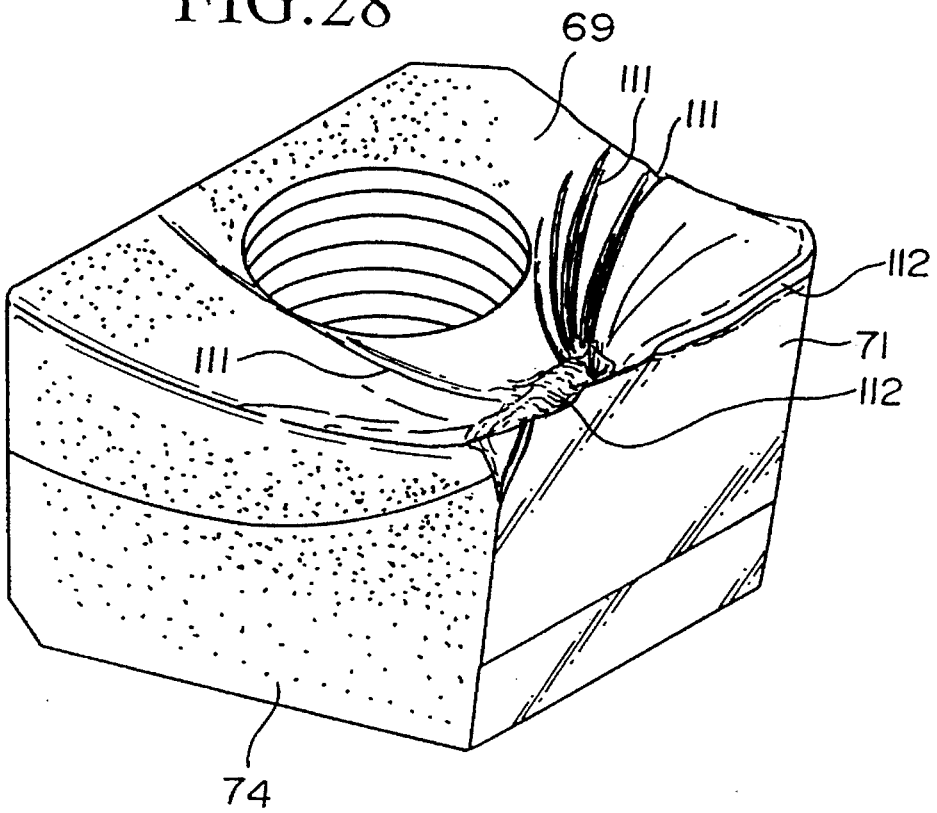
FIG. 28 is a perspective view showing a prior art wedge member after having been subjected to a cutting test.
Figure 27A:
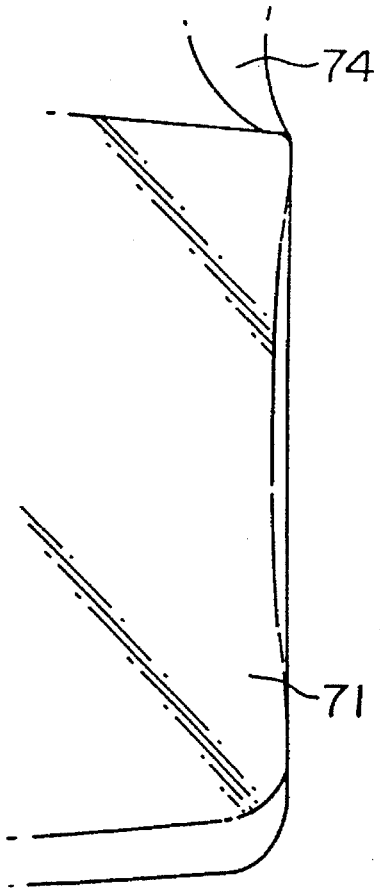
FIG. 27(*a*) is a left side-elevational view of the wedge member of FIG. 26.
Figure 27B:
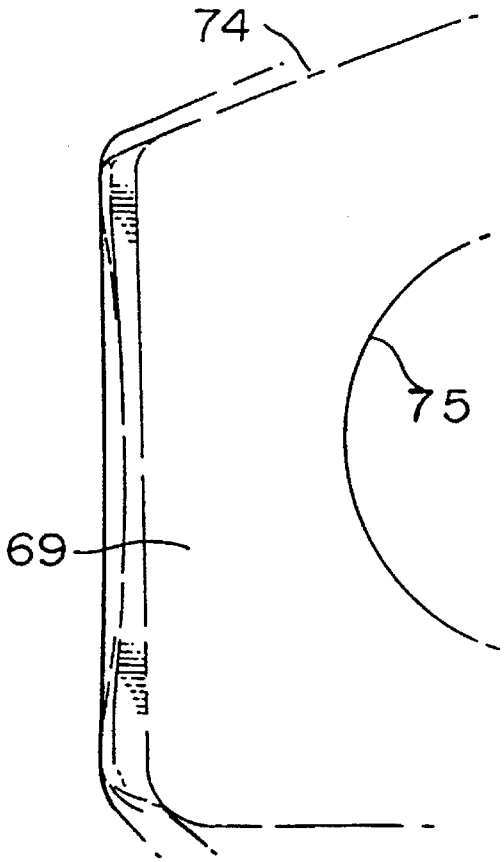
Figure 27C:
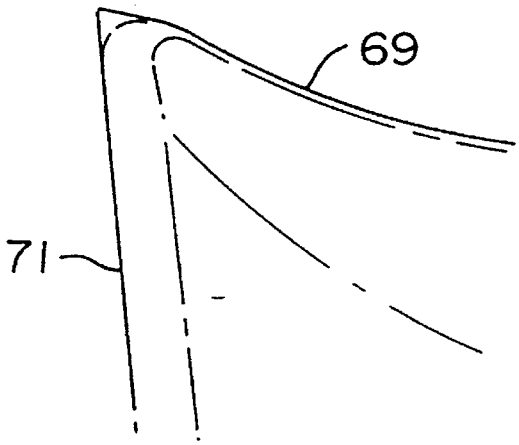
Figure 29A:
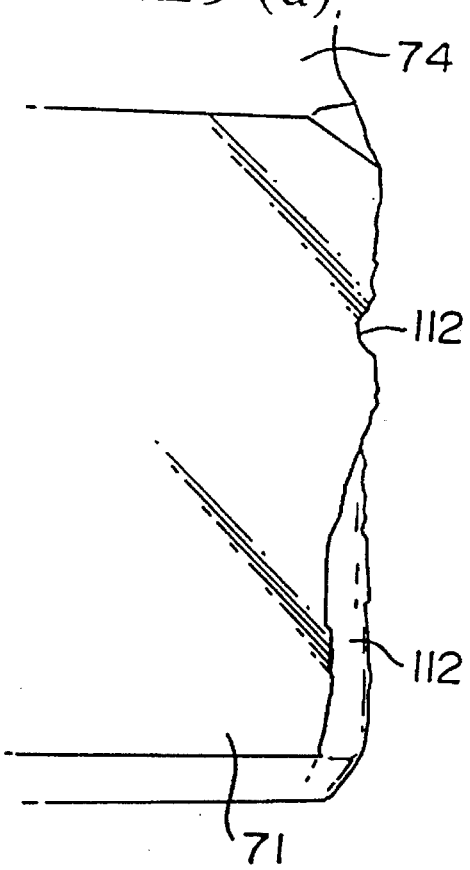
FIG. 29(*a*) is a left side-elevational view of the wedge member of FIG. 28.
Figure 29B:
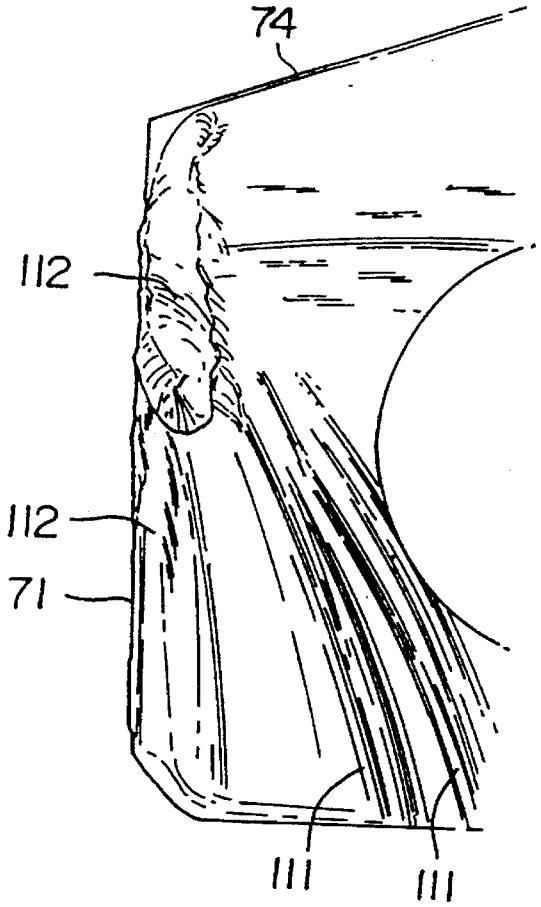
Figure 29C:
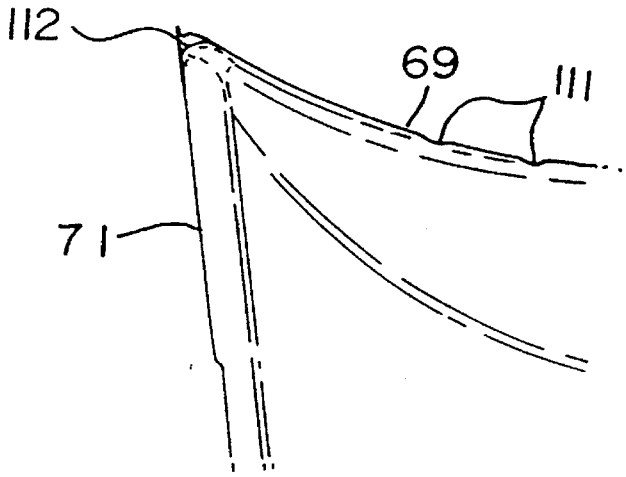
Figure 30A:
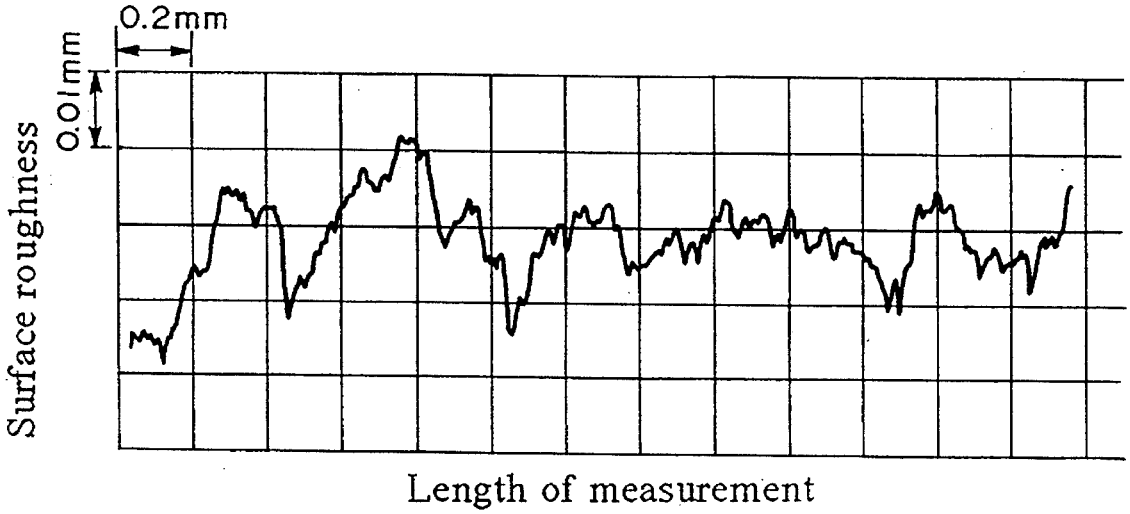
FIG. 30(*a*) is a graphical representation showing the surface roughnesses of the front face of the improved wedge member measured prior to the cutting test.
Figure 30B:
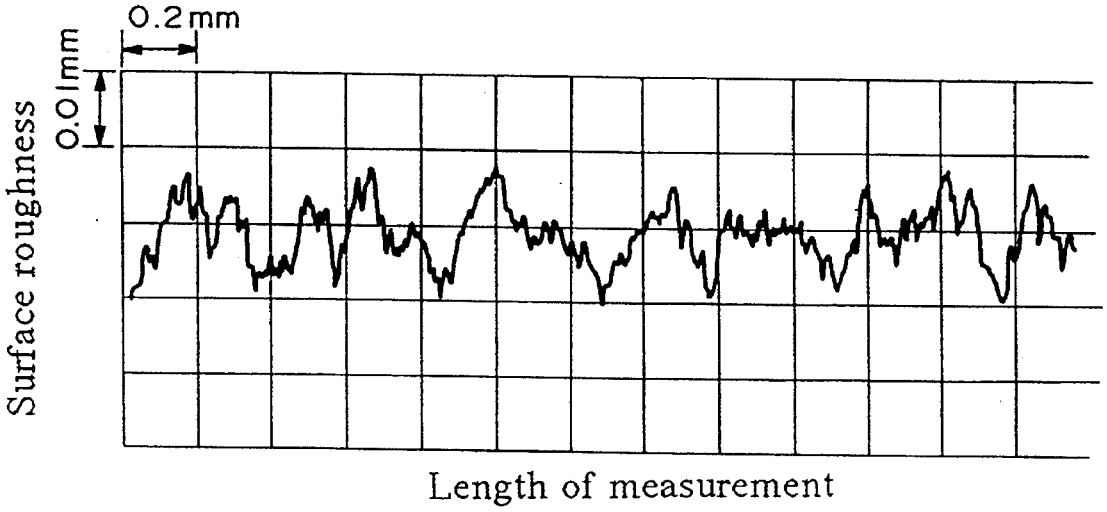
Figure 31A:
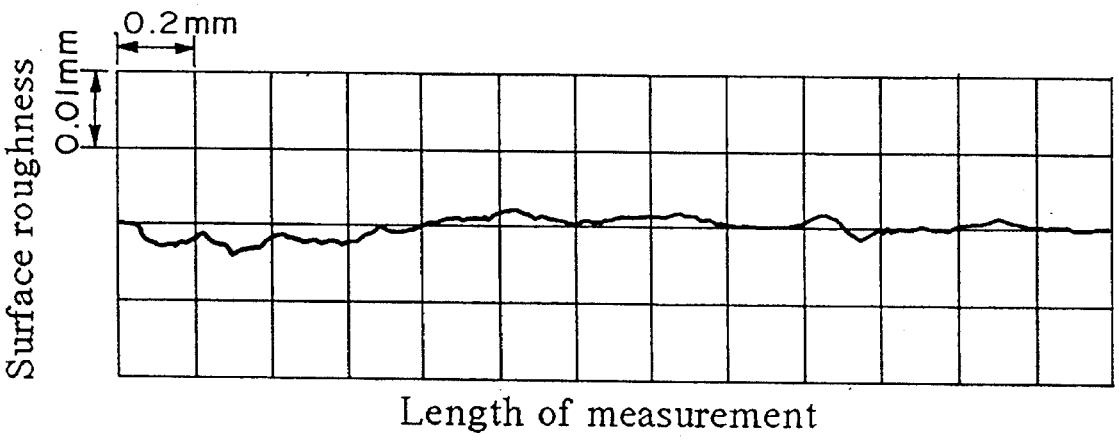
FIG. 31(*a*) is a view similar to FIG. 30(*a*), but showing the surface roughness after the cutting test.
Figure 31B:
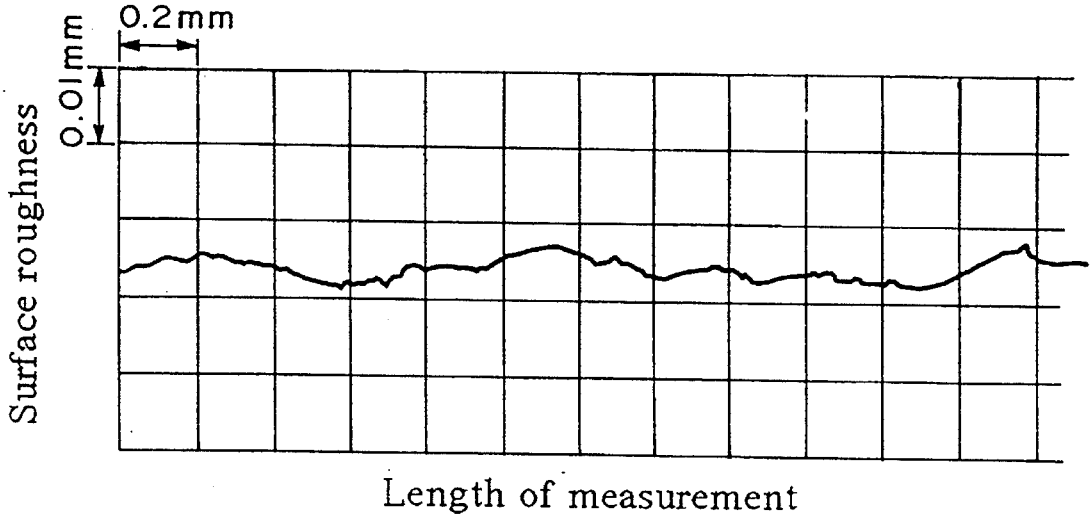

A wedge member, which had the same construction as in FIGS. 15 to 18, was manufactured. For comparative purposes, a comparative wedge member, which did not have a hard layer, was also prepared. Then, these wedge members were secured to a single face milling cutter which had the same construction as described in the embodiment shown in FIGS. 1 to 4, and the cutting tests were carried out to compare the damage caused on both the wedge members. Furthermore, for reference purposes, the surface roughness of the front face of each wedge member was measured before and after the cutting work. The outside appearances of the wedge members of the invention are shown in FIGS. 26 and 27, while those for the comparative wedge members are shown in FIGS. 28 and 29. As to the results of the measurement of the surface roughness, the data before the cutting are shown in FIG. 30, while those after the cutting are shown in FIG. 31.

The following are the dimensions of the face milling cutter used in this test, and the cutting conditions.

Dimensions of face milling cutter

Outer diameter of tool: 250 mm

Number of inserts: 12

Cutting conditions

Cutting speed V: 150 m/min.

Feed $S_Z$: 0.15 mm/tooth

Workpiece: Steel (JIS: SS41)

Width of cut: 160 mm

Depth of cut: 2 to 4 mm

Cutting time: two months (about 320 hours)

As shown in FIGS. 26 and 27, although the wearing of the wedge member of the invention is seen on the front face after the lapse of two months, its development is very satisfactory, and significant damage is not recognized. Slight wearing 110 is only seen on the front face. In contrast, in the comparative wedge member, as will be seen from FIGS. 28 and 29, the development of the wearing is striking, and in addition, scratching 111 or fracturing 112 has occurred, so that the damage due to the frictional abutting of the cutting chips is considerably great. Thus, the wedge member of the invention is superior to the comparative member.

In the foregoing, as will be clearly seen from FIGS. 30(*a*) and 30(*b*) which show the surface roughness prior to the cutting, both of the wedge members had irregularities caused by the precision casting. On the other hand, as will be seen from FIGS. 31(*a*) and 31(*b*) which show the surface roughness after the lapse of two months from the commencement of the cutting, the irregularity of the surface is smoothed by the development of the wearing. In this connection, although wearing has developed, the wedge member of the invention as shown in FIGS. 31(*a*) is further smoothed than the comparative wedge member of FIG. 31(*b*). This does not indicate that the wedge member of the invention is more susceptible to wear, but that the front face of the comparative wedge member is roughened more easily by the cutting chips.

Obviously, many modifications and variations of the present invention are possible in the light of the above. It is therefore to be understood that within the scope of the appended claims, the invention may be practiced otherwise than as specifically described.

What is claimed is:

1. A method for manufacturing a cutter, comprising the steps of:

(a) preparing a plug formed of a material with resistance to nitriding;

(b) threading said plug into a tapped hole formed in a tool body;

(c) subsequently subjecting said tool body to a nitriding treatment to form a hard layer on the surface of said tool body; and (d) subsequently removing said plug from said tool body in such a manner so as to be re-usable.

2. A method for manufacturing a cutter, comprising the steps of:

(a) forming an unnitrided portion on a surface of a plug;

(b) threading said plug into a tapped hole formed in a tool body;

(c) subsequently subjecting said tool body to a nitriding treatment to form a hard layer on the surface of said tool body; and (d) subsequently removing said plug from said tool body in such a manner so as to be re-usable.

3. A manufacturing method as recited in claim 1, further comprising forming a tapered surface tapering inwardly of said tool body at an open end of said tapped hole, and employing as said plug a screw having a tapered portion to be held in direct contact with said tapered surface of said tapped hole.

4. A manufacturing method as recited in claim 2, further comprising a tapered surface tapering inwardly of said tool body at an open end of said tapped hole, and employing as said plug a screw having a tapered portion to be held in direct contact with said tapered surface of said tapped hole.

* * * * *